United States Patent [19]

Jenne

[11] 4,357,525

[45] Nov. 2, 1982

[54] GLOW PLUG DUTY CYCLE MODULATING APPARATUS

[75] Inventor: Richard Jenne, Attleboro, Mass.

[73] Assignee: Texas Instruments Incorporated, Dallas, Tex.

[21] Appl. No.: 118,285

[22] Filed: Feb. 4, 1980

[51] Int. Cl.[3] ..... H05B 1/02; F02N 17/00

[52] U.S. Cl. ..... 219/511; 219/504; 219/505; 219/486; 219/202; 219/519; 219/508; 123/179 H; 337/102; 337/104

[58] Field of Search ..... 219/505, 486, 504, 508, 219/509, 510, 511, 519, 490, 494, 202, 203; 337/102, 104, 103, 105; 123/179 H, 179 B, 179 BG, 145 A

[56] References Cited

U.S. PATENT DOCUMENTS

| | | | |
|---|---|---|---|
| 3,748,439 | 7/1973 | Ting et al. | 219/494 |
| 4,104,507 | 8/1978 | Tisone et al. | 219/505 |
| 4,177,785 | 12/1979 | Sundeen | 123/179 H |
| 4,201,735 | 5/1980 | Byam | 219/511 |

*Primary Examiner*—M. H. Paschall

*Attorney, Agent, or Firm*—John A. Haug; James P. McAndrews; Melvin Sharp

[57] ABSTRACT

A control for modulating the duty cycle of diesel engine glow plugs has two heat sensitive, normally closed switches each thermally coupled to a respective positive temperature coefficient (PTC) of resistivity heater in turn thermally coupled to and mounted on a common heat sink. The heat sensitive switches are serially connected to each other, to an ignition switch and to a glow plug relay. The PTC heaters are connected to a point between the heat sensitive switches and the relay and to ground. A third PTC heater is mounted on the heat sink intermediate the first and second heaters and thermally coupled to the heat sink. The third heater is connected to an alternator and serves to cut off power to the glow plugs after a selected after glow stage. The two heat sensitive switches can be selected to open at approximately the same temperature for a random operating mode or at slightly different temperatures for a sequential operating mode. The random operating mode is a redundant high reliability operating mode whereas the sequential operating mode, using slightly different temperatures allows one switch to control the cycling and the second to be a back up safety control. In one preferred embodiment a "wait" lamp is connected between the ignition switch and a double pole relay used to latch the lamp in the deenergized state when the first "off" time of the heat sensitive switches occurs. In a second embodiment the "wait" lamp is connected between the alternator and the coil of the glow plug relay with a diode serially connected to the lamp to preclude alternator current from energizing the lamp.

4 Claims, 12 Drawing Figures

GLOW PLUG DUTY CYCLE MODULATING APPARATUS

CROSS-REFERENCES TO RELATED APPLICATIONS

This invention relates to copending patent applications, Ser. Nos. 118,286 and 118,285 by Lawrence E. Cooper and Youn H. Ting respectively, assigned to the assignee of present application and filed of even date therewith.

BACKGROUND OF THE INVENTION

The present invention relates to electric heater controls and more specifically to means for modulating the duty cycle of glow plugs used for starting diesel engines.

In order to start a diesel engine, such as one of the prechamber injection type, it is common practice to employ electrically heated glow plugs which extend into the chamber and to preheat these plugs to a temperature above the flash temperature of the fuel prior to cranking of the engine, known as a preglow stage, and thereafter to maintain the plugs at such temperature for a selected period of time while the engine warms up sufficiently, known as an after glow stage, and then to deenergize the plugs. Historically the preglow stage has been considered excessively long for people accustomed to conventional spark ignition engines since typically a full minute or more of glow plug preheating was required before the engine could be cranked. Such glow plugs in effect are high resistance heater elements and are heated by current drawn from the battery until the glow plugs reach approximately 1800° F. when a so called "wait" lamp is deactivated indicating that the engine is ready to be cranked. After a selected time delay to provide an after glow period the glow plugs are deenergized. Such glow plugs not only require excessive time for preheating but the time required has been too dependent upon the level of the supply voltage. That is, if the voltage level happened to be somewhat low significantly longer time was required to preheat the glow plugs until they reached the flash temperature of the fuel.

Recently, a fast start system has been developed in which the glow plugs are heated to the desired temperature much more quickly, in the order of six or seven seconds. This is accomplished by using glow plugs with a lower resistance to obtain more heat generation and to thereafter cycle the glow plugs on and off with a selected duty cycle in order to maintain the glow plugs within a selected range for the after glow period. Such a system is described in a technical paper published by the SAE (Society of Automotive Engineers) on Feb. 26–Mar. 2, 1979, entitled "Design of a Fast Start Glow Plug Control System For Diesel Engines" written by Arthur R. Sundeen. While the control described in the paper is effecetive in preheating the glow plugs in a greatly reduced time period and is effective in maintaining the plugs within a selected temperature range for an afterglow period it does suffer from several disadvantages. That is, the control employs three creep acting bimetallic switches arranged to operate in a particular sequence. Each bimetal is heated by a wire wound or printed heater. There are many hand operations required in making the control, e.g. soldering of the wire or painted heaters to associated parts, calibration of the switches to assure the desired sequential operation, and the like. As a result the control is inherently expensive to produce and subject to problems of yield and reliability. For instance the heater wire wound about the bimetallic blade is of small gauge and could easily be broken thereby changing the sequence of operation.

SUMMARY OF THE INVENTION

It is an object of this invention to provide a novel and improved control system for supplying power to diesel engine glow plugs. Another object is the provision of a control which is a thermal analog of an electrically heatable resistance heater and to modulate its duty cycle to maintain the heater within a selected temperature range and to thereafter deenergize the heater. Yet another object is the provision of such apparatus which is simple, easy to assembly yet reliable and inexpensive. Another object is the provision of such apparatus which is less likely to be improperly installed than prior art devices. Still another object is the provision of apparatus having an improved and simple control for a visual indicating lamp.

Briefly described the novel and improved control system of this invention comprises a generally cylindrical housing provided with a threaded end portion which is received in a threaded bore in the engine block. Within the housing a body of thermally insulative material is telescopically received which mounts an elongated heat sink bar having a top surface on which are mounted thermally coupled thereto spaced first and second heaters of positive temperature coefficient (PTC) of resistance material. A heat responsive switch is disposed on top of and thermally coupled to each PTC heater. The heat responsive switches are serially connected to each other and are adapted to be connected to the ignition switch of the vehicle and to the coil of a glow plug relay which controls the energization of the glow plugs. That is, the glow plugs are connected to the battery of the vehicle through contacts of the glow plug relay. The first and second PTC heaters are connected between the heat sensitive switches and ground so that upon closing of the ignition switch battery current will flow through the heat sensitive switches and the PTC heaters. Thus even though the switches are thermally coupled to the PTC heaters heat is transferred to the switches at a reduced rate due to the effect of the common heat sink bar which draws heat from the PTC heaters. The heat sensitive switches are selected so that they are normally closed and preferably switch to an open contacts configuration at approximately the same temperature to obtain random operation of one of the two switches although if sequential operation is desired the switches can be selected to switch to an open contacts configuration at slightly different temperatures. The random operating mode provides redundant high reliability while using slightly different temperatures allows one switch to control the cycling and the other to be a back up safety control. When one of the heat sensitive switches reaches its actuation temperature it deenergizes both switches and PTC heaters thereby permitting the system to cool until the heat sensitive switches reclose and the system continues to cycle on and off with a particular duty cycle determined by the thermal coupling of the switches, heaters and heat sink.

A third PTC heater is mounted on and thermally coupled to the heat sink bar and is disposed intermediate the two heat sensitive switches. The third PTC heater is connected to the alternator of the vehicle so that once the engine is started current flows through the third PTC heater which will be transferred to the two heat sensitive switches to eventually, after the desired after glow period, maintain at least one of the switches above its actuation temperature and thereby in its open contacts position and cut off energization of the glow plugs.

In one preferred embodiment a visual indicating "wait" lamp is energized during the first "on" period of the heat sensitive switches and is then latched "off" by a separate relay used for that purpose. In a second preferred embodiment the lamp is connected between the alternator and the coil of the glow plug relay with a diode generally serially connected to the lamp in order to block current from the alternator. Thus the lamp will be energized whenever the glow plugs are energized until the engine is started and the alternator back feeds the lamp.

Other objects, advantages and details of the novel and improved modulating apparatus appear in the following detailed description of preferred embodiments of the invention, the detail description referring to the drawings.

DESCRIPTION OF THE PREFERRED EMBODIMENTS

Figure 1A:
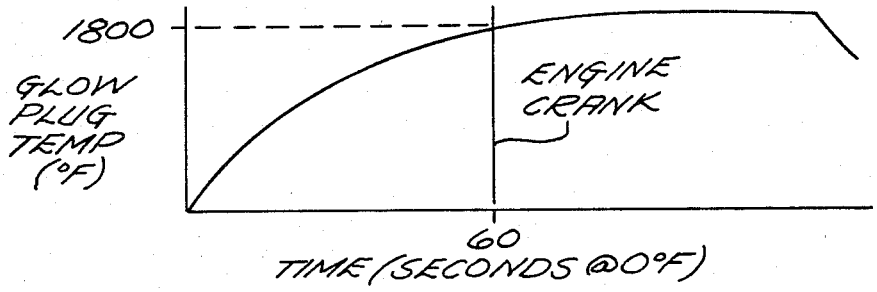
FIG. 1*a* is a graph of glow plug temperature versus time for a conventional slow start system.
Figure 1B:
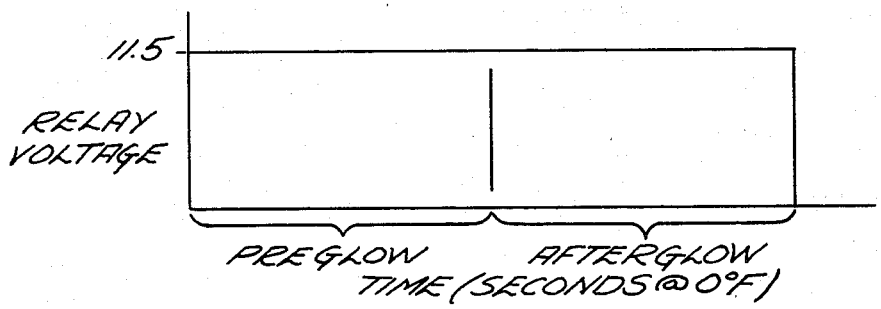
FIG. 1*b* is a graph of voltage of the coil of a relay used to energize the glow plugs versus time for the FIG. 1 system.

Referring to the drawings, in FIG. 1*a* a graph of the temperature of a conventional glow plug versus time upon energization is shown. The plugs are preheated to 1800° F. which is above the flash point of the fuel, prior to engine cranking which takes approximately 60 seconds at an ambient temperature of 0° F. As seen in FIG. 1*b* the plugs are energized continuously during the preglow period until the engine is started as well as during an after glow period while the engine warms up to a sufficiently high temperature at which point the glow plugs are deenergized.

Figure 2A:
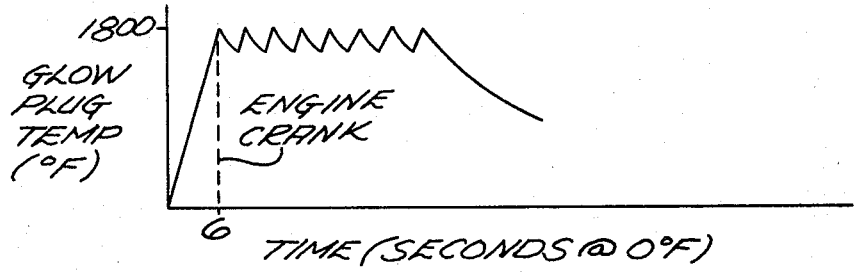
FIG. 2*a* is a graph of glow plug temperature versus time for a fast start system of the present invention.
Figure 2B:
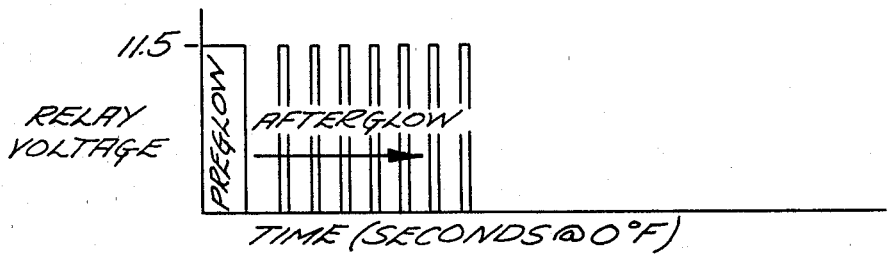
FIG. 2*b* is a graph of voltage of the coil of the glow plug relay versus time for the FIG. 2*a* system.

In a fast warm up start system the temperature of the glow plugs are brought up to 1800° F. much more quickly, in the order of 6 to 7 seconds, as seen in FIGS. 2*a* and *b*, and then following the point at which the engine can be cranked the plugs are cycled off and on for the after glow period.

Figure 3:
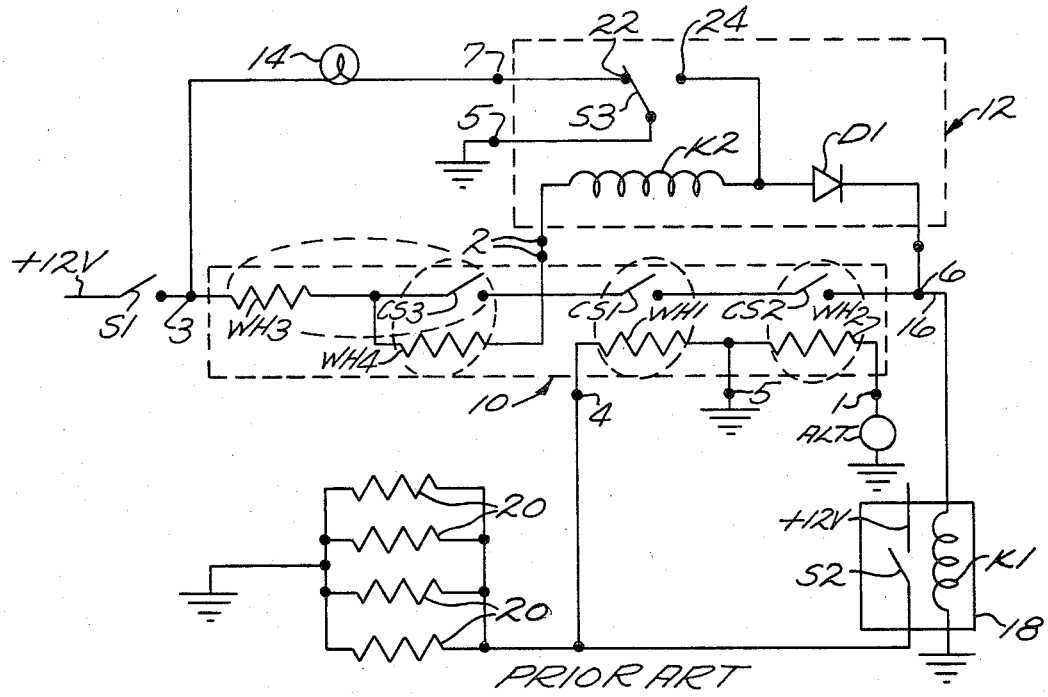
FIG. 3 is a schematic circuit diagram of a prior art fast start system.

The glow plugs used in the fast warm up start system have a lower resistance value in order to generate heat more quickly. FIG. 3 shows a system used to maintain the temperature of the plugs within the desired operating range. A controller 10 is connected to the ignition switch S1 and is provided with an output 16 connected to coil K1 of a glow plug relay 18. When coil K1 is energized normally open switch S2 is closed connecting a bank of glow plugs 20 to a source of power. A relay 12 is provided to control energization of a "wait" lamp 14. Relay 12 comprises a coil K2 which is adapted to affect the position of two pole switch S3. When coil K2 is not energized switch S3 engages contact 22 and when energized the switch engages contact 24. A diode D1 is placed in series with coil K2 with contact 24 connected between the coil K2 and the anode of diode D1.

Controller 10 is provided with six pins, pin 1 being connectable with alternator ALT which in turn is connected to ground. Pin 2 is connected to coil K2 of relay 12, pin 3 to the ignition switch, pin 4 to a point intermediate the bank of glow plugs and the glow plug relay 18. Pin 5 is connected to ground and pin 6 to a point intermediate coil K1 of relay 18 and the cathode of diode D1. Within controller 10 pin 4 is connected to a first heater WH1 which is serially connected to a second WH2 which in turn is connected to pin 1. Pin 5 is connected to a point intermediate heaters WH1 and WH2. A first normally closed bimetal switch CS1 is thermally coupled to heater WH1 and is connected in series with a second normally closed creep action bimetal switch CS2 which is thermally coupled to heater WH2. Switch CS2 is connected to pin 6 while switch CS1 is connected both to pin 2 and to a third normally closed creep action bimetal switch CS3. Switch CS3 is serially connected to a third heater WH3 which in turn is connected to pin 3 and is also thermally coupled to heater WH3. A fourth heater WH4 is connected across switch CS3 and is thermally coupled thereto.

When the ignition switch S1 is initially closed the battery, a 12 volt power source, energizes the system so that current flows through pin 3, heater WH3, switches CS3, CS1 and CS2, pin 6, coil K1 of relay 18 to ground. With coil K1 energized switch S2 closes permitting current to flow from the battery to glow plugs 20. At the same time "wait" lamp 14 is energized with current flowing through the ignition switch, point 22, switch S3 to ground. With switch S2 closed current also flows through heater WH1 which causes switch CS1 to open after a selected period of time, that is, approximately 6 seconds. When switch CS1 opens current is shunted through coil K2 which causes switch S3 to move from contact 22 to contact 24 thereby deenergizing "wait" lamp 14. Switch S3 is latched in that position with current passing through coil K2 being shunted to ground. Following deenergization of coil K and opening of switch S2 and concomitant deenergization of heater WH1 switch CS1 cools and recloses thereby reenergizing coil K1 closing switch S2 and reenergizing glow plugs 20. Thus the glow plugs cycle on and off with a duty cycle such as to maintain the glow plugs within a selected temperature range. Once the engine is started the alternator supplies current to heater WH2 which, after a selected period of time providing the desired after glow period, causes switch CS2 to open and thereby finally deenergizing the bank of glow plugs. The alternator continues to supply current to heater WH2 maintaining switch CS2 in the open condition.

Switch CS3 is a back up switch which is activated in the event that the primary switch CS1 does not open for some reason, which may happen due to welded contacts, for instance. Heat is transferred from heater WH3 to switch CS3 which after a short time delay beyond the time selected for switch CS1 to open, for example 3 seconds, will cause switch CS3 to open and be latched in the open position by means of heater WH4.

While the system shown in FIG. 3 does provide the desired temperature control of the glow plugs it has several disadvantages. Controller 10 is relatively expensive and difficult to manufacture due to the many parts and soldered connections. The heaters are constructed of fine wire wound about strips of bimetal or are screen printed on a plastic film disposed on the bimetal. The fine heater wire is very fine and subject to breakage. Each device, after being assembled, must be carefully calibrated to provide the 3 second delay between actuation of switches CS1 and CS3. The heater WH1 for operating the control is wired outside of controller 10 (from pin 4 to the point intermediate the glow plug relay 18 and the glow plugs and therefore subject to miswiring.

Figure 4:
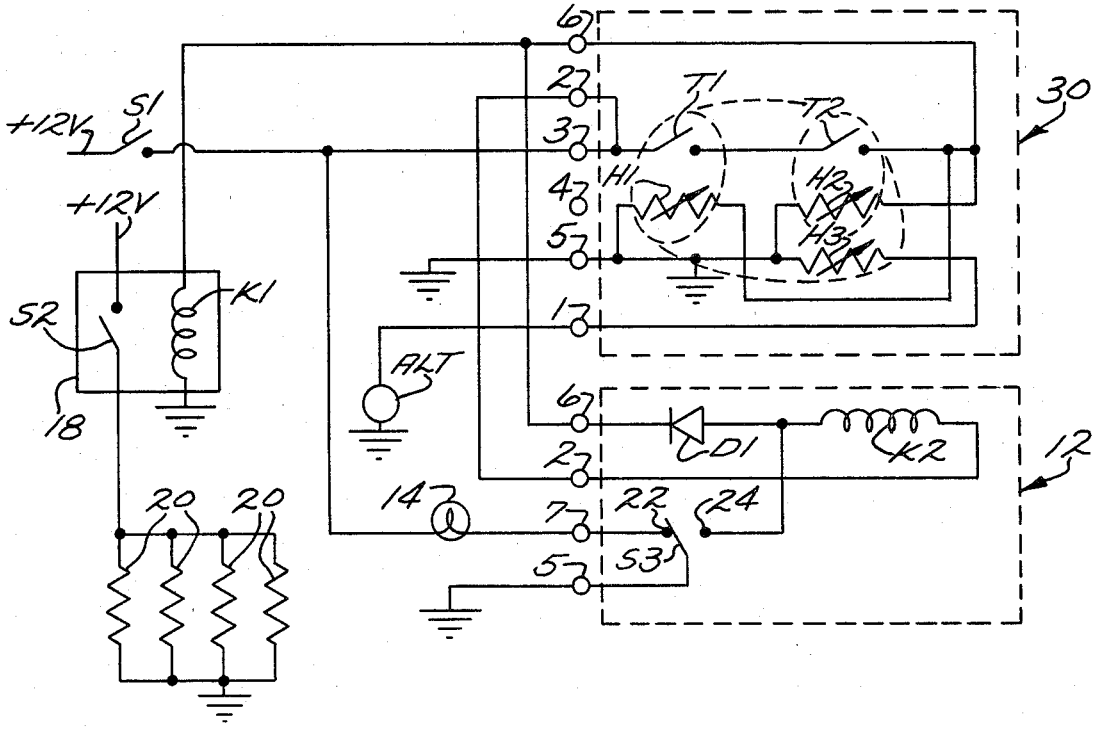
FIG. 4 is a schematic circuit diagram of a first preferred embodiment of a fast start system made in accordance with the invention.

The above disadvantages are overcome by the present invention as will be explained below. With reference to FIG. 4 a controller 30 is shown having six connector pins, as in controller 10. Controller 30 is designed to be accomodated into the same housing as controller 10 so that it can be used as a direct replacement therefor. Controller 30 comprises a first snap acting thermostatic switch T1 serially connected to a second snap acting thermostatic switch T2. One terminal of switch T1 is connected to pins 2 and 3 while the other terminal of switch T1 is connected to one terminal of switch T2. The other terminal of switch T2 is connected to pin 6. First and second heaters H1, H2 comprised of material having a positive temperature coefficient (PTC) of resistance are connected in parallel circuit relation with each other between pins 5 and 6. A third PTC heater H3 is connected between pin 5 and pin 1. As indicated by the dashed lines switch T1 is thermally coupled to heater H1 and H3 while switch T2 is thermally coupled to heater H2 and H3.

Controller 30 is connected into the glow plug energization system by connecting pin 6 to the coil of glow plug relay 18, pin 5 to ground, pin 2 to coil K2 of lamp relay 12, pin 3 to ignition switch S1 and pin 1 to alternator ALT, all as in FIG. 3. However, pin 4 is not connected whereas in FIG. 3 pin 4 is used to provide power for heater WH1 from the power source of the glow plugs. In the FIG. 4 embodiment it will be noted that heaters H1 and H2 obtain their power from a connection within controller 30 to thereby obviate the possibility of faulty wiring outside the controller when it is being installed in the vehicle and thus avoids the need for diagnostic circuitry which would otherwise be desirable.

When ignition switch S1 is initially closed the contacts of switches T1 and T2 are closed and conduct current to heaters H1 and H2 as well as to coil K1 of glow plug relay 18. Energization of coil K1 causes switch S2 to close thereby closing a circuit between the battery and a bank of glow plugs 20. It will be understood that although four glow plugs are shown in FIG. 4, any number of plugs can be provided as desired. Current from the battery passing through heaters H1 and H2 is transferred to heat sensitive switches T1 and T2 raising the temperature of the heat responsive element of the switches until one of the switches actuates to a contacts open configuration. Deenergization of the switches serves to deenergize the glow plugs as well as the PTC heaters. Once the heat responsive element of the switch which actuated to a contact open configuration cools off to its reset temperature the switch will be reactuated to the contacts closed configuration and the glow plugs will once again be energized. The glow plugs will cycle on and off with a particular duty cycle dependent upon the effect of a heat sink thermally coupled to the PTC heaters to be explained in detail infra, particularly with regard to FIGS. 7 and 8.

When ignition switch S1 is closed current will flow through "wait" lamp 14, contact 22, switch S3 to ground. Energization of lamp 14 serves as a sign to the operator of the vehicle to wait to initiate cranking of the engine until the selected preglow period has expired. When one of switches T1, T2 actuates to the contacts open configuration current is caused to flow through terminal 2 and coil K2 of relay 12 thereby energizing the coil and causing the double pole switch S3 to switch from the pole embodying contact 22 to the pole embodying contact 24. Once this occurs lamp 14 is deenergized and the relay is latched into the pole position embodying contact 24. The operator now cranks the engine thereby causing the alternator ALT to generate voltage and current is conducted through heater H3 which is transferred to heat sensitive switches T1, T2 until one of the switches moves to the contacts open configuration thereby cutting off current to the glow plugs until the ignition switch is opened. The length of time required for this to occur corresponds to the afterglow stage and is dependent upon the effect of the heat sink explained infra.

Figure 5:
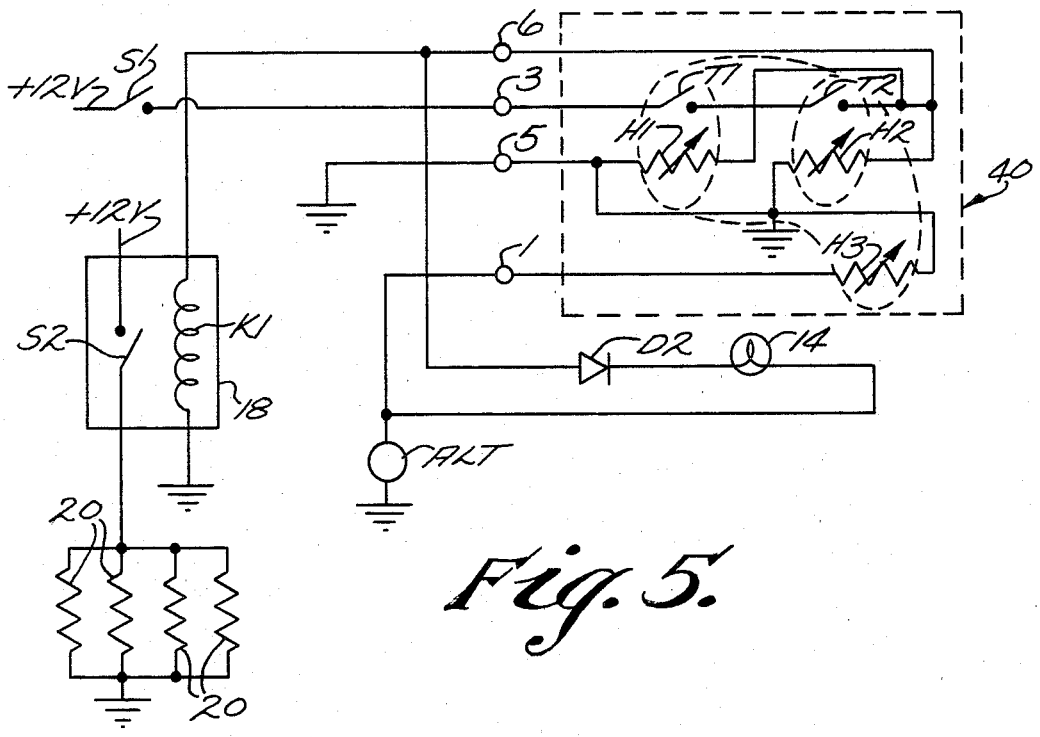
FIG. 5 is a schematic circuit diagram of a second preferred embodiment of a fast start system made in accordance with the invention.
Figure 6:
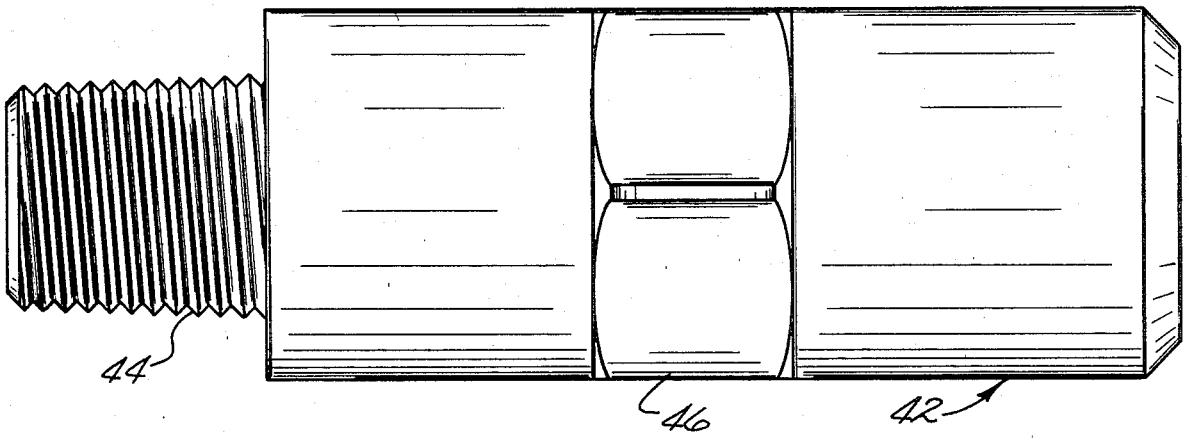
FIG. 6 is a top plane view of a modulator apparatus used in the invention, particularly as shown in FIG. 4.

In FIG. 5 there is shown a simplified four pin controller which can be used without latching relay 12. In this controller the same snap acting thermostatic switches T1 and T2 are used serially connected to each other and connected between pins 3 and 6. PTC heaters H1 and H2 are connected in parallel circuit relation with one another between pins 6 and 5 while PTC heater H3 is connected between pins 1 and 5. As in the FIG. 4 embodiment, one side of each of the PTC heaters is connected to ground through pin 5. Wait lamp 14 is connected to the positive side of alternator ALT and to the cathode of diode D2. The anode of diode D2 is connected to pin 6.

When ignition switch S1 is closed current flows through the normally closed switches T1, T2, pin 6, coil K1 to ground thereby energizing relay 18 closing the contacts of switch S2 and energizing the glow plugs. Closing of the ignition switch also allows current to flow through heaters H1 and H2 to ground and through diode D2 and wait lamp 14 to alternator ALT and ground. Energization of wait lamp 14 indicates to the operator that the glow plugs are being heated. Heat generated in heaters H1 and H2 are transferred to switches T1 and T2 respectively as indicated by the dashed lines in FIG. 5 until one of the switches reaches its operating temperature at which point it will move to a contacts open configuration thereby deenergizing the glow plugs, heaters H1 and H2 and wait lamp 14. When the actuated switch cools to its reset temperature it will switch to its contacts closed position again reenergizing the glow plugs, heaters H1, H2 and lamp 14. This cyclical operation will continue until the operator cranks the engine so that the alternator produces a voltage which causes back feeding of lamp 14 preventing further energization of the lamp. Current also flows from the alternator to heater H3 to generate heat therein, which, as indicated by the dashed lines, is transferred to switches T1, T2 until one of the switches is brought to its operating temperature to actuate the switch to deenergize the glow plug relay 18. Continued operation of alternator ALT keeps heater K3 energized thereby maintaining the actuated switch T1 or T2 in its open contacts position.

Figure 7:
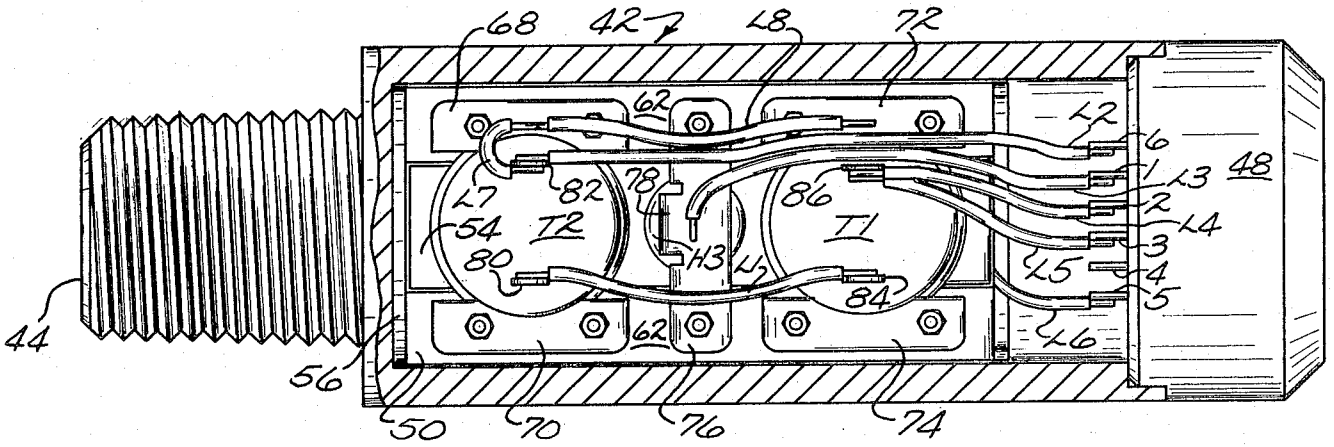
FIG. 7 is a view similar to FIG. 6 but broken away to show the internal components.
Figure 8:
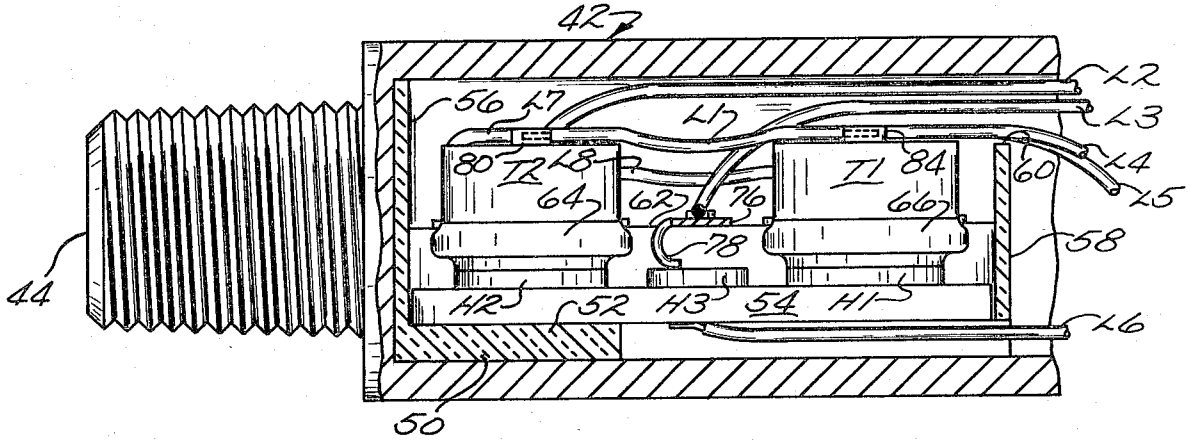
FIG. 8 is a front elevation of a portion of the FIG. 7 apparatus.
Figure 9:
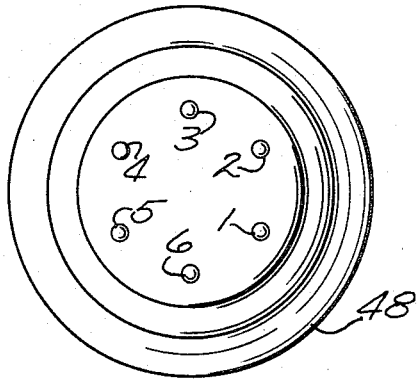
FIG. 9 is a side view of the FIG. 6 apparatus showing the connector pin configuration.

With particular reference to FIGS. 6–9 a controller 30 described in FIG. 4 is shown to comprise a housing 42, generally cylindrical in configuration and having a threaded end 44 for reception in a threaded aperture of an engine block. A hexagonal portion 46 is provided intermediate its ends to facilitate mounting and dismounting from the block. Telescopically received within housing 42 is a connector 48 mounting pins 1–6 (see FIG. 9) and a base 50 formed of electrically and thermally insulative material, such as a suitable moldable resin. Base 50 is provided with a first end wall 56, generally cylindrical having a diameter such that it closely fits within housing 42 and a similar second end wall 58 at its opposite end but with a cut off portion at 60 to provide space for leads to extend from within base 50 to connector 48. Base 50 is provided with a flat platform portion 62 on its side walls extending between end walls 56, 58. PTC heaters H1, H2 and H3 are disposed on the top surface of electrically conductive heat sink bar 54 in electrical connection therewith and spaced along the length of the bar. Thermostat T2 is disposed on top of heater H2 with cap 64 of thermostat T2 in electrical connection therewith and thermally coupled thereto. In like manner thermostat T1 is disposed on top of heater H1 with cap 66 of thermostat T2 in electrical connection therewith and thermally coupled thereto. Electrically conductive brackets 68, 70 are fixed to platform 62 by conventional screws on the like and project over a portion of cap 64 to retain thermostat T2 in place. In like manner electrically conductive brackets 72, 74 are fixed to platform 62 and cooperate with cap 66 to retain thermostat T1 in place. If desired, electrical connection between brackets 68 and 72 and caps 64, 66 respectively can be enhanced by using solder to make a positive connection therebetween. The side walls of base 50 are cut away to closely receive opposite portions of thermostats T1 and T2 as seen in FIG. 7. Electrically conductive bracket 76 is fixed to platform 62 intermediate the thermostats T1, T2 and is provided with a finger portion 78 which is biased against the top face of heater H3 to make electrical connection therewith. Thermostat T2 has a first terminal 80 connected to a first terminal 84 of thermostat T1 by a lead line L1. Lead line L2 connects terminal 82 of thermostat T2 with pin 6 of connector 48 while lead line L3 extends from pin 1 of connector 48 to bracket 76. Terminal 86 of thermostat T1 is connected to pins 2 and 3 of connector 48 via lead lines L4 and L5. Lead line L6 extends from pin 5 of connector 48 to heat sink bar 54 (FIG. 8). Lead line L7 extends from terminal 82 to bracket 68 and lead line L8 extends from bracket 68 to bracket 72. The several lead lines are affixed by suitable means such as solder. Heaters H1, H2, H3 are connected to ground through pin 5 and also may be connected directly through housing 42 to the block of the vehicle.

Figure 10:
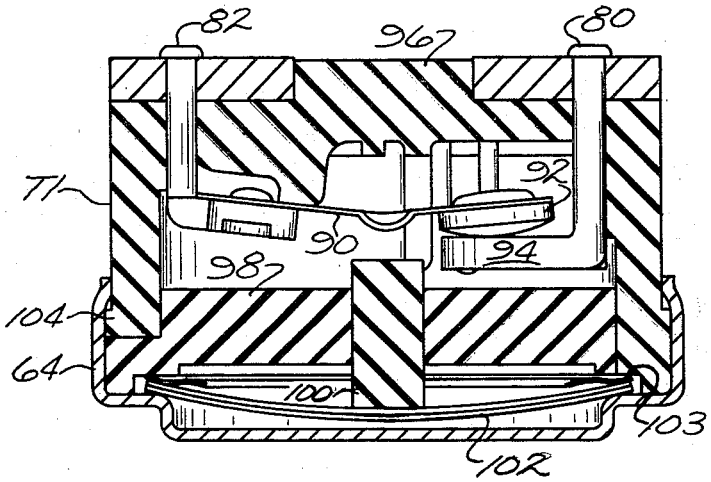
FIG. 10 is an enlarged cross sectional view of a heat sensitive switch shown in FIGS. 7 and 8.

The thermostats shown in FIGS. 7 and 8 are of the type shown in cross section in FIG. 10 and comprise a first terminal member 80 mounting a stationary contact 94 and a second terminal 82 which mounts a movable contact arm 90 having a movable contact 92 mounted on a free distal end portion thereof adapted to move into and out of engagement with fixed contact 94. Housing 96, in which terminals 80, 82 are mounted is closed at one end by a pin guide 98 which slidlingly mounts a pin 100 which extends from movable arm 90 to a snap acting, thermostatic disc 102. Cap 64 serves as a heat conductor to bring heat to disc 102. An annular wave spring 103 is preferably placed between snap acting disc 102 and guide 98 to maintain the disc in optimum thermal contact with cap 64 so that the switch is insensitive to position orientation. That is, whether the switch is mounted as shown or upside down the terminal response will not be affected. When the temperature of the disc rises to a selected level the disc will snap to a configuration opposite to that shown in FIG. 10 with the center of the disc moving upwardly forcing pin 100 and moving movable arm 90 upwardly to cause the contacts to disengage.

It will be noted that the top portion of cap 64 is clinched over a flange 104 to fix the cap to base 96. This smaller diameter portion of the cap also serves as a retainer flange cooperating with brackets 68, 70 (and 72, 74 for thermostat T2) to keep thermostat T1 in its seat. Further details of a suitable heat sensitive switch may be had in U.S. Pat. No. 4,079,348 which issued Mar. 14, 1978.

PTC heater elements H1, H2 and H3 may be composed of ceramic type semi conductive material such as barium lead titanate doped with a rare earth such as lanthanum. When such material is placed in an electrical circuit, it initially draws a substantial amount of current which rapidly raises its temperature to a certain value without substantial change in resistance. As the temperature continues to rise an anomaly temperature is reached beyond which the resistance rapidly increases with only a small increase in temperature. The heater elements are provided with electrically conductive layers on opposite faces thereof which may be applied by any conventional method, such as electroless nickel soldering, flame spraying, or the like. In order to optimize heat transfer from H1, H2 to the switches it is preferred to attach them to the switch caps using a thin layer of silver epoxy. Each switch and heater then forms a unit and is then held firmly against the heat sink bar 54 by means of brackets 68, 70 and 72, 74. Heater H3 is preferably attached to heat sink bar 54 by means of silver epoxy.

In order to obtain the desired rate of heating for heaters H1 and H2 they are chosen to have a base resistance (that is the resistance at temperatures below the anomaly) of between approximately 4 and 6 ohms. However, heater H3 is chosen to have a somewhat higher base resistance of between approximately 15–20 ohms in order to prevent excessive power being drawn from the alternator.

Use of heat sensitive switches T1 and T2 on a common heat sink provides both the primary modulating control as well as a back up device which will be actuated in the event that there is a malfunction in one of the switches. With the heat sensitive switches selected to open at approximately the same temperature a random and redundant high reliability operating mode is provided whereas using switches which open at slightly different temperatures a sequential operating mode is provided with one switch controlling the cycling and the other serving as a back up safety control. Heater H3 advantageously utilizes the common heat sink to finally cut off power to the glow plugs via either of switches T1 and T2. The particular duty cycle of the modulator is dependent on the effects of the heat sink which draws heat from the PTC heater thereby delaying actuation of the heat sensitive switches for a certain period of time. Thus the invention provides simple, inexpensive yet reliable modulation of the duty cycle of glow plugs.

It will be understood that various modifications of the described embodiments of this invention are possible within the scope of this invention and that the invention includes all modifications and equivalents thereof falling within the scope of the appended claims.

I claim:

1. Apparatus for providing a thermal analog of an electrically heatable resistance heater and to modulate the duty cycle of power supplied to such resistance heater comprising a housing, a heat sink having a surface disposed in the housing, first and second ceramic like heater elements having a positive temperature coefficient (PTC) of resistance above an anomaly temperature mounted on the surface of the heat sink in thermally coupled relation therewith, a heat sensitive switch mounted on top of each of the first and second heater elements in thermally coupled relation with each respective heater element, means to connect the switches in series circuit relation and connectable to means controlling the energization of the resistance heater and to an energizing switch, one of the two switches modulating the current flow to the resistance heater, the other of the two switches service as a back up protector, means to electrically energize the first and second heater elements concomitantly with the energization of the resistance heater means to interrupt flow to the resistance heater upon the occurrence of a preselected condition comprising a third ceramic like heater element mounted on the surface of the heat sink and thermally coupled thereto and means to electrically energize the third heater element, heat generated by the third heater being transferred to the first and second heater elements so that after a given time at least one of the first and second heater elements will be maintained above its anomaly temperature to thereby keep its respective heat sensitive switch deenergized.

2. Apparatus according to claim 1 in which the third heater element is composed of material having a positive temperature coefficient (PTC) of resistance.

3. Apparatus according to claim 2 in which the heater elements are composed of barium lead titanate doped with a rare earth.

4. Apparatus for providing a thermal analog of an electrically heatable resistance heater and to modulate the duty cycle of power supplied to such resistance heater comprising a housing, a heat sink having a surface disposed in the housing, a ceramic like heater element having a positive temperature coefficient (PTC) of resistance above an anomaly temperature mounted on the surface of the heat sink in thermally coupled relation therewith, a heat sensitive switch mounted on top of the heater element in thermally coupled relation therewith, means to connect the switch to means controlling the energization of the resistance heater and to an energizing switch, and means to electrically energize the heater element concomitantly with the energization of the resistance heater, means to interrupt flow to the resistance heater upon the occurrence of a preselected condition comprising another ceramic like heater element mounted on the surface of the heat sink and thermally coupled thereto and means to electrically energize the said another heater element, heat generated by the said another heater being transferred to the heater element so that after a given time the heater element will be maintained above its anomaly temperature to thereby keep the heat sensitive switch deenergized.

* * * * *